US008639411B2

(12) United States Patent
Bruno et al.

(10) Patent No.: US 8,639,411 B2
(45) Date of Patent: Jan. 28, 2014

(54) METHOD TO DIAGNOSE A FAULT OF AN OIL PISTON COOLING JETS VALVE

(75) Inventors: Morena Bruno, Chivasso (IT); Michele Bilancia, Turin (IT)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/472,718

(22) Filed: May 16, 2012

(65) Prior Publication Data

US 2012/0296518 A1 Nov. 22, 2012

(30) Foreign Application Priority Data

May 19, 2011 (GB) ..... 1108392.0

(51) Int. Cl.
*G01M 15/09* (2006.01)

(52) U.S. Cl.
USPC ..... 701/34.4; 340/514; 340/517

(58) Field of Classification Search
USPC ..... 701/34.4; 340/514, 517
See application file for complete search history.

(56) References Cited

U.S. PATENT DOCUMENTS

2011/0283968 A1* 11/2011 Anderson et al. ..... 123/196 R

FOREIGN PATENT DOCUMENTS

| | | | |
|---|---|---|---|
| DE | 102009038676 | A1 | 6/2011 |
| GB | 2478545 | A | 9/2011 |
| JP | 2008038705 | A | 2/2008 |

* cited by examiner

*Primary Examiner* — Mary Cheung
*Assistant Examiner* — Brian P Sweeney
(74) *Attorney, Agent, or Firm* — Ingrassia Fisher & Lorenz, P.C.

(57) ABSTRACT

Methods for diagnosing a fault of an oil piston cooling jets valve of an internal combustion engine are provided. A method includes sensing a pressure value in a main oil gallery and checking whether the oil piston cooling jets valve is commanded in a state for opening a communication between the main oil gallery and an auxiliary oil gallery or in a state for closing the communication. A pressure value in the auxiliary oil gallery is checked to as to whether it exceeds a predetermined threshold value thereof, above which a jet nozzle of the auxiliary oil gallery automatically opens. A fault of the valve is identified if the pressure value in the main oil gallery exceeds the predetermined threshold value by a predetermined quantity and if a pressure value in the auxiliary oil gallery is different than expected on a basis of the state of the valve.

20 Claims, 3 Drawing Sheets

METHOD TO DIAGNOSE A FAULT OF AN OIL PISTON COOLING JETS VALVE

CROSS-REFERENCE TO RELATED APPLICATION

This application claims priority to British Patent Application No. 1108392.0, filed May 19, 2011, which is incorporated herein by reference in its entirety.

TECHNICAL FIELD

The technical field generally relates to a method to diagnose a fault of an Oil Piston Cooling Jets (OPCJ) valve of an internal combustion engine, in particular an internal combustion engine of a motor vehicle, such as a diesel engine or a spark ignited engine.

BACKGROUND

It is known that an internal combustion engine of a motor vehicle typically includes an oil system suitable for lubricating the rotating or sliding components of the engine. The oil system generally has an oil pump driven by the engine, which draws lubricating oil from a sump and delivers it under pressure through a main oil gallery of the engine cylinder block. The main oil gallery is connected via respective pipes to a plurality of exit holes for lubricating crankshaft bearings (main bearings and big-end bearings), camshaft bearings operating the valves, tappets, and the like.

In order to cool and lubricate the engine pistons and the related cylinders, the oil system further includes a plurality of jet nozzles individually provided for squirting oil into an upper crankcase area towards the engine pistons. Each jet nozzle is usually equipped with a check valve that automatically opens the jet nozzle only if the oil pressure exceeds a predetermined threshold value thereof.

In modern internal combustion engines, the jet nozzles can be connected to a common auxiliary oil gallery, also referred as an Oil Pistons Cooling Jets (OPCJ) gallery. The OPCJ gallery is realized in the cylinder block of the internal combustion engine and communicates with the main oil gallery through an electrically driven valve, conventionally referred as a squirters valve or an Oil Piston Cooling Jets (OPCJ) valve.

This OPCJ valve is generally controlled by an engine control unit (ECU) according to a managing strategy contrived for allowing an effective cooling of the pistons and consequently a significant fuel saving and polluting emission reduction. This managing strategy is usually performed with the aid of a wide range pressure sensor located in the main oil gallery, namely a sensor capable to sense the actual value of the pressure over a wide range of values.

At least one object herein is to provide a method to diagnose a fault of the OPCJ valve, namely whether the OPCJ valve effectively opens and closes the communication between the main gallery and the auxiliary gallery in response of the commands delivered by the ECU. Another object is to provide a simple and rational method, which implies cheaper hardware requirements than the known method. In addition, other objects, desirable features and characteristics will become apparent from the subsequent summary and detailed description, and the appended claims, taken in conjunction with the accompanying drawings and this background.

SUMMARY

Various embodiments of methods to diagnose a fault of an oil piston cooling jets valve of an internal combustion engine are provided herein. In an exemplary embodiment, a method includes:

- sensing a value of pressure in the main oil gallery,
- checking whether the oil piston cooling jets valve is commanded in a state for opening the communication between the main oil gallery and the auxiliary oil gallery or in a state for closing this communication,
- checking whether a value of pressure in the auxiliary oil gallery exceeds a predetermined threshold value thereof, above which a jet nozzle of the auxiliary oil gallery automatically opens,
- identifying a fault of the oil piston cooling jets valve if the pressure value in the main oil gallery exceeds the threshold value by at least a predetermined quantity, and if the result of the pressure check in the auxiliary oil gallery is different than expected on the basis of the commanded state of the oil piston cooling jets valve.

In this regard, the diagnostic method can be performed by placing in the auxiliary oil gallery a simpler switch pressure sensor, for example, a sensor capable only of sensing whether the pressure exceeds a predetermined threshold value or not, and setting this threshold value to the pressure value above which the check valves of the jet nozzles open. The switch pressure sensor is far cheaper than a wide range pressure sensor such that the implementation of the diagnostic method is less expensive than prior art methods.

According to an embodiment, the pressure value in the auxiliary oil gallery is expected to exceed the threshold value if the pressure value in the main oil gallery exceeds the threshold value by at least the predetermined quantity, and if the oil piston cooling jets valve is commanded in the state for opening the communication between the main oil gallery and the auxiliary oil gallery. Under these conditions, the diagnostic method is therefore able to properly identify a fault of the OPCJ valve if the result of the pressure check in the auxiliary oil gallery indicates that the pressure value therein does not exceed the threshold value.

According to another embodiment, the pressure value in the auxiliary oil gallery is expected to not exceed the threshold value if the pressure value in the main oil gallery exceeds the threshold value by at least the predetermined quantity, and if the oil piston cooling jets valve is commanded in the state for closing the communication between the main oil gallery and the auxiliary oil gallery. Under these conditions, the diagnostic strategy is therefore able to properly identify a fault of the OPCJ valve if the result of the pressure check in the auxiliary oil gallery indicates that the pressure value therein exceeds the threshold value.

In a further embodiment, the predetermined quantity by which the pressure value in the main oil gallery should exceed the threshold value quantifies a pressure drop between the main oil gallery and the auxiliary oil gallery. In this regard, the method provides a more reliable result. In order to further increase the reliability of the method, the predetermined quantity can be determined as a function of a value of engine speed and a value of oil temperature.

The methods contemplated herein can be carried out using a computer program comprising a program-code for carrying out all the steps of the methods described above, and in the form of a computer program product comprising the computer program.

In this regard, an internal combustion engine can include an electronic control unit (ECU), a data carrier electrically coupled to the ECU, and a computer program stored in the data carrier, so that, when the ECU executes the computer program, all the steps of the method described above are carried out.

The method can be also embodied as an electromagnetic signal, the signal being modulated to carry a sequence of data bits which represent a computer program to carry out all steps of the method.

Another embodiment provides an apparatus for diagnosing a fault of an oil piston cooling jets valve of an internal combustion engine, wherein the apparatus comprises:

means for sensing a value of pressure in the main oil gallery, means for checking whether the oil piston cooling jets valve is commanded in a state for opening a communication between the main oil gallery and an auxiliary oil gallery or in a state for closing this communication, means for checking whether a value of pressure in the auxiliary oil gallery exceeds a predetermined threshold value thereof, above which a jet nozzle of the auxiliary oil gallery automatically opens, means configured for identifying a fault of the oil piston cooling jets valve if the pressure value in the main oil gallery exceeds the threshold value by at least a predetermined quantity and if the result of the pressure check in the auxiliary oil gallery differs from what is expected on the basis of the commanded state of the oil piston cooling jets valve.

This embodiment allows a reliable detection of the fault with a simple and cheaper solution.

Still another embodiment provides an automotive system having an internal combustion engine (ICE) including a main oil gallery and an auxiliary oil gallery communicating via an oil piston cooling jets valve, a jet nozzle communicating with the auxiliary oil gallery, a wide range pressure sensor located in the main oil gallery, a switch pressure sensor located in the auxiliary oil gallery, and an electronic control unit (ECU) in communication with the oil piston cooling jets valve with the wide range pressure sensor and with the switch pressure sensor, wherein the ECU is configured to:

sense a value of pressure in the main oil gallery from the wide range pressure sensor, check whether the oil piston cooling jets valve is commanded in a state for opening a communication between the main oil gallery and an auxiliary oil gallery or in a state for closing the communication, compare, by means of the switch pressure sensor, whether a value of pressure in the auxiliary oil gallery exceeds a predetermined threshold value thereof, above which the jet nozzle of the auxiliary oil gallery automatically opens, and identify a fault of the oil piston cooling jets valve if the pressure value in the main oil gallery exceeds the threshold value by a predetermined quantity and if the result of the pressure check in the auxiliary oil gallery is different than expected on the basis of the commanded state of the oil piston cooling jets valve.

Again, this embodiment allows for a reliable detection of the fault with a simple and cheaper solution.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the various embodiments or the application and uses thereof. Furthermore, there is no intention to be bound by any theory presented in the preceding background or the following detailed description.

Figure 1:
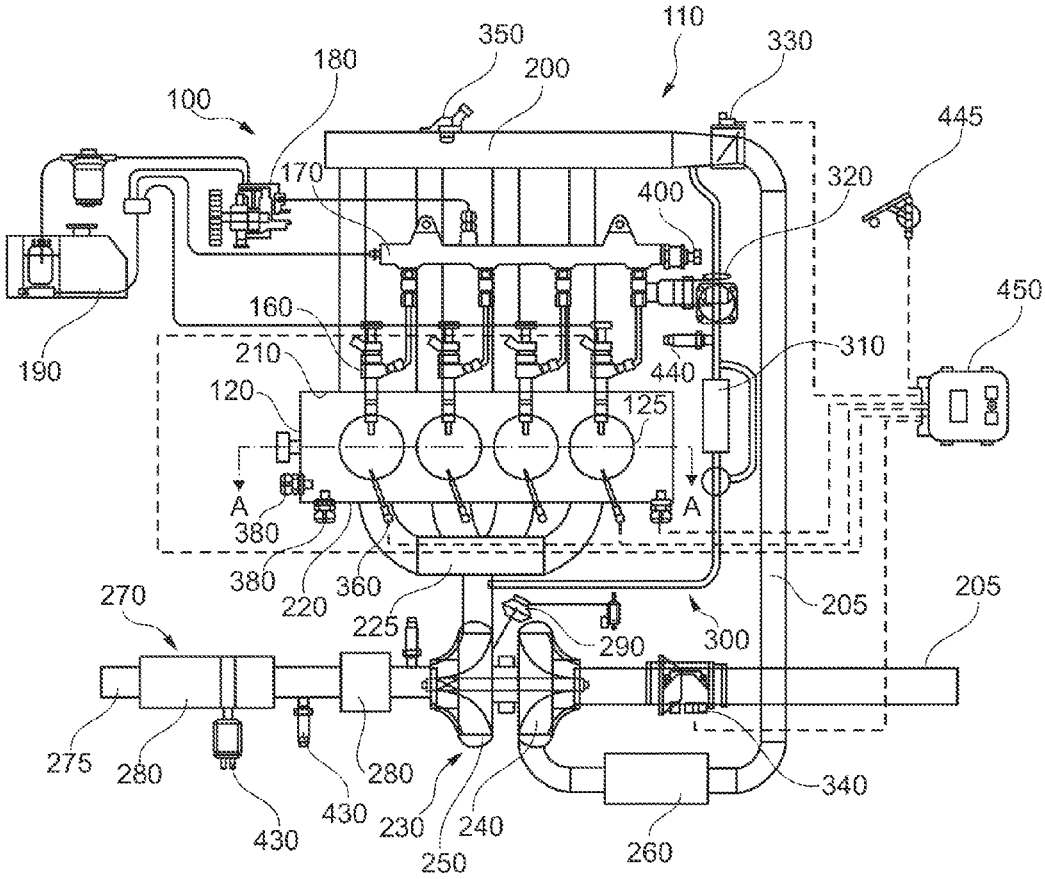
FIG. 1 shows a schematic illustration of an automotive system in accordance with an exemplary embodiment.
Figure 2:
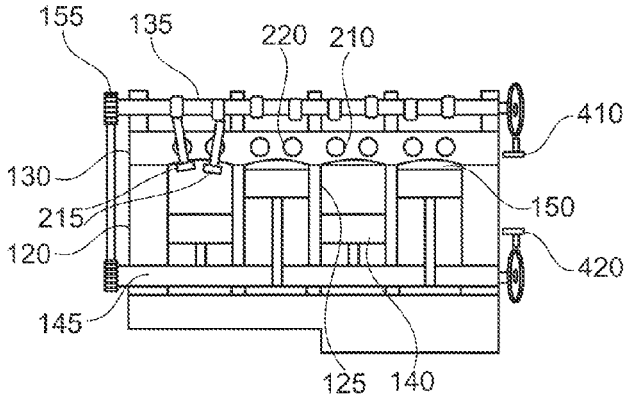
FIG. 2 is a section of an internal combustion engine belonging to the automotive system of FIG. 1.

An automotive system 100, as shown in FIGS. 1 and 2, includes an internal combustion engine (ICE) 110 having an engine block 120 defining at least one cylinder 125 having a piston 140 coupled to rotate a crankshaft 145, in accordance with an exemplary embodiment. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increases the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust aftertreatment devices 280. The aftertreatment devices may be any device configured to change the composition of the exhaust gases. Some examples of aftertreatment devices 280 include, but are not limited to, catalytic converters (two and three way), oxidation catalysts, lean NOx traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, the VGT actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system and an interface bus. The CPU is configured to execute instructions stored as a program in the memory system, and send and receive signals to/from the interface bus. The memory system may include various storage types including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

Figure 3:
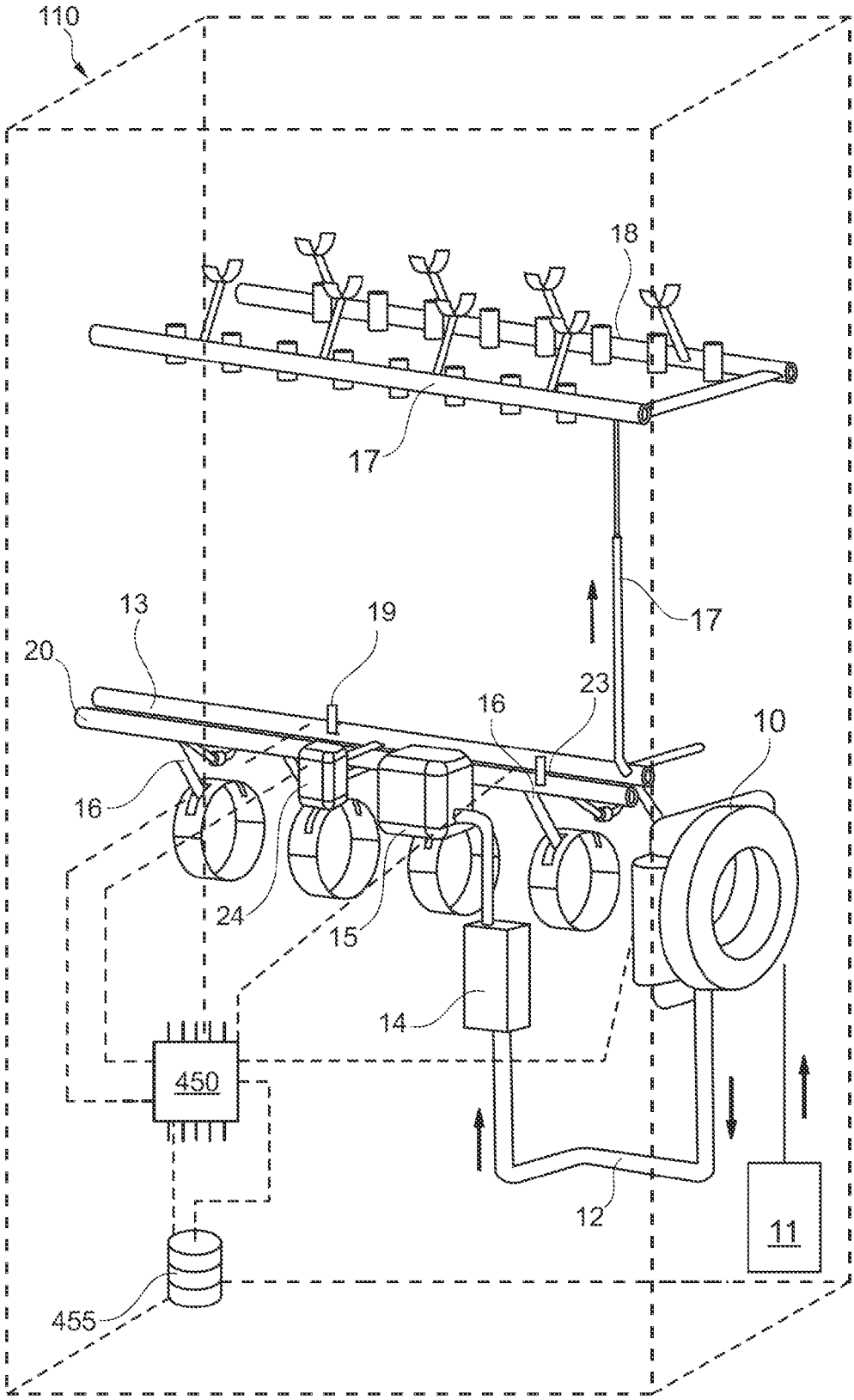
FIG. 3 is a schematic representation of an oil system of the internal combustion engine of FIG. 2.

Referring to FIG. 3, the internal combustion engine 110 (roughly represented in dotted line) is provided with a lubrication system comprising a Variable Displacement Oil Pump (VDOP) 10 driven by the engine itself, which draws lubricating oil from a sump 11 and delivers it under pressure, via a feeding line 12, to a main oil gallery 13 in the engine block 120.

During the normal operation of the engine 110, the VDOP 10 can be commanded in order to selectively change its state from a high displacement configuration to a low displacement configuration or vice versa, thereby causing a significant variation of the pressure of the lubricating oil into the main oil gallery 13. The feeding line 12 includes an oil cooler 14 and, with an oil filter 15 respectively cools and filters the lubricating oil flowing therein.

The main oil gallery 13 is connected via respective pipes 16 to a plurality of exit holes for lubricating crankshaft bearings (main bearings and big-end bearings). Through a head supply pipe 17 and a plurality of connecting pipes 18, the main oil gallery 13 is further connected to a plurality of exit holes for lubricating the camshaft bearings operating the valves, tappets, and the like. The main oil gallery 13 is equipped with a wide range pressure sensor 19, which is suitable for measuring the pressure of the lubricating oil therein.

Figure 4:
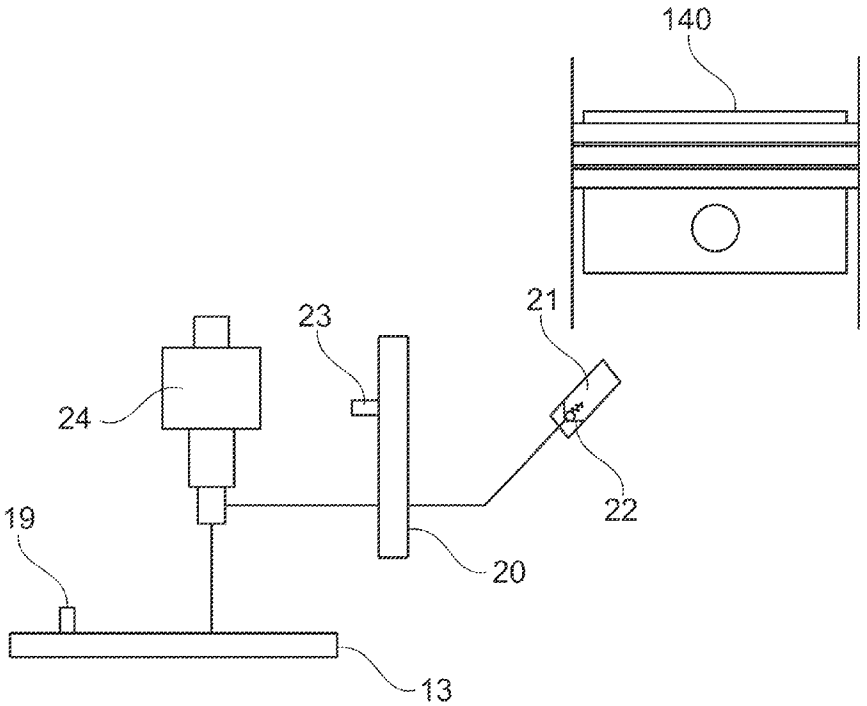
FIG. 4 is a schematic representation of a portion of the oil system of FIG. 3.

As shown in FIG. 4, the oil system comprises an auxiliary oil gallery 20 in the engine cylinder block, which is connected to a jet nozzles 21 provided for squirting lubricating oil into an upper crankcase area towards an engine piston 140. Although FIG. 4 shows only one jet nozzle 21, it should be understood that the oil system is provided with at least a jet nozzle 21 per engine piston, and that all the jet nozzles 21 are connected to the same auxiliary oil gallery 20 via respective pipes.

Each jet nozzle 21 incorporates a mechanical check valve 22, which is configured for automatically opening the jet nozzle 21 if the oil pressure in the auxiliary oil gallery 20 exceeds a predetermined threshold value, which is hereafter indicated as Pth and which is typically set to 1.2 bar. If the oil pressure in the auxiliary oil gallery 20 decreases below the threshold value Pth or remains below the threshold value Pth, then the check valve 22 respectively closes the jet nozzle 21 or keeps it closed.

The auxiliary oil gallery 20 is equipped with a simple and cheap switch pressure sensor 23, for example, which is suitable only for sensing whether the pressure of the lubricating oil at the inlet of the check valve 22 exceeds the threshold value Pth or not. In an embodiment, the switch pressure sensor 23 is calibrated to switch if the sensed pressure of the auxiliary oil gallery 20 exceeds a related threshold value Pth* that is greater than the threshold value Pth by a quantity corresponding to the pressure drop between the check valve 22 and the auxiliary oil gallery 20.

The auxiliary oil gallery 20 is connected to the main oil gallery 13 via an electrically driven Oil Piston Cooling Jets (OPCJ) valve 24, which can be selectively commanded in an open state, in which it opens the communication between the main oil gallery 13 and the auxiliary oil gallery 20, or in a closed state, in which it closes such a communication. In greater detail, the OPCJ valve 24 closes the communication when it is electrically powered, whereas it opens the communication when the electrical power is cut off.

The OPCJ valve 24 is controlled by an engine control unit (ECU) 450, which allows and prevents the OPCJ valve 24 to be electrically powered, according to a predetermined strategy that is contrived to achieve an effective cooling of the pistons.

Figure 5:
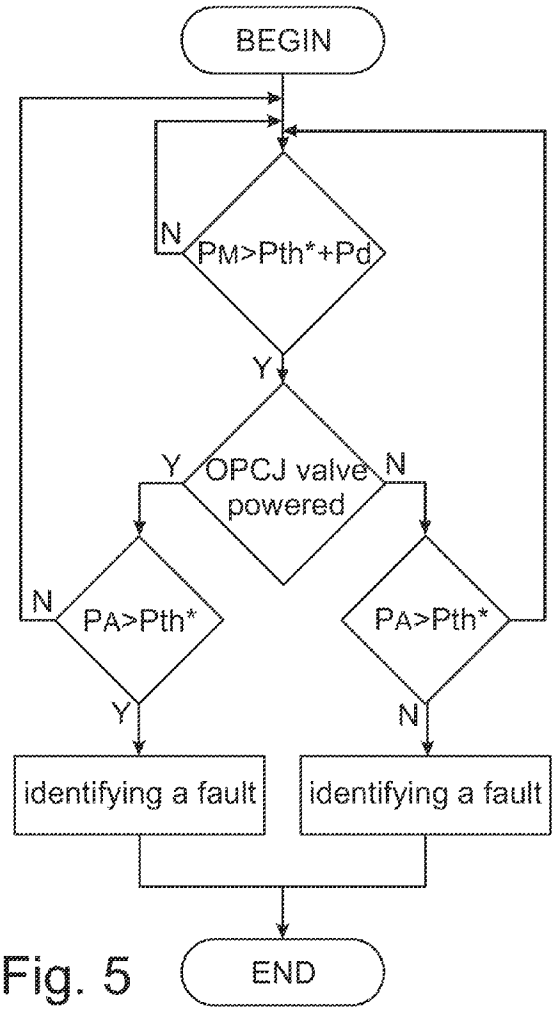
FIG. 5 is a flowchart representing a method for diagnosing whether an OPCJ valve is working properly, according to an exemplary embodiment.

In an embodiment, a method for diagnosing whether the OPCJ valve 24 is working properly is provided. This diagnostic method is schematically illustrated in the flowchart of FIG. 5. The diagnostic method firstly provides for sensing, by means of the wide range pressure sensor 19, the pressure in the main oil gallery 13, and for checking whether the sensed value PM thereof exceeds the above mentioned threshold value Pth* increased by a corrective additional quantity Pd. The corrective quantity Pd quantifies a pressure drop of the lubricating oil flowing between the main oil gallery 13 and the auxiliary oil gallery 20, and it can be determined as a function of an actual value of engine speed and an actual value of the lubricating oil in the oil system.

As long as the sensed pressure value PM does not exceed the sum Pth+Pd, the strategy simply repeats the measuring of the pressure in the main oil gallery 13, because it means that the check valves 22 prevent the oil from squirting toward the pistons 140, even if the OPCJ valve 24 is defective.

When the sensed pressure value PM exceeds the sum Pth*+Pd, the strategy provides for checking whether the OPCJ valve 24 is commanded in the closed state or in the open state, in the present example whether it is electrically powered or not.

If this first check returns that the OPCJ valve 24 is electrically powered, it means that the OPCJ valve 24 should be closed and thus the pressure value in the auxiliary oil gallery 20 is expected to not exceed the threshold value Pth*.

Accordingly, the strategy provides for comparing, by means of the switch pressure sensor 23, whether the pressure value PA in the auxiliary oil gallery 20 actually exceeds the threshold value Pth* or not. If the pressure value PA in the auxiliary oil gallery 20 does not exceed the threshold value Pth*, it means that the OPCJ valve 24 is closed as expected, so that no fault of the OPCJ valve 24 has occurred and the method is repeated. If conversely, the pressure value PA in the auxiliary oil gallery 20 does exceed the threshold value Pth*, it means that the OPCJ valve 24 is unexpectedly stuck open and a fault of the OPCJ valve 24 is identified.

The OPCJ valve 24 being stuck open is not a great problem, because the ICE 110 continues to operate properly except for slight increases of the fuel consumption and pollutant emission, which nevertheless generally do not exceed the legal limits thereof. Accordingly, when a fault is identified as explained above, no specific recovery strategy is necessary and it is even possible to do nothing. At the most, an alert flag can be activated by the ECU 450 for signaling to check the OPCJ valve 24 at the next service.

Returning now to the first check, if the first check indicates that the OPCJ valve 24 is not electrically powered, it means that the OPCJ valve 24 should be open and thus the pressure value in the auxiliary oil gallery 20 is expected to exceed the threshold value Pth*. Also in this case the strategy provides for comparing, by means of the switch pressure sensor 23, whether the pressure value PA in the auxiliary oil gallery 20 actually exceeds the threshold value Pth* or not. If so, it means that the OPCJ valve 24 is open as expected, so that no fault of the OPCJ valve 24 has occurred and the method is repeated. If conversely, the pressure value PA in the auxiliary oil gallery 20 does not exceed the threshold value Pth*, it means that the OPCJ valve 24 is unexpectedly stuck closed and a fault of the OPCJ valve 24 is identified.

The OPCJ valve 24 being stuck closed can be a serious problem for a correct operation of the ICE 110, because it prevents a proper lubrication and cooling of the pistons 140. For this reason, when a fault is identified in this way, a specific recovery strategy is advisable. By way of example, this recovery strategy can provide for limiting the engine load and/or the engine torque, in order to decrease the demand for cooling and lubrication. If the ICE 110 is equipped with a VDOP 10, as in the present example, the recovery strategy can further provide for constantly keeping the VDOP 10 in the high displacement configuration, so as to increase the pressure in the portion of lubrication system that is still working, and thus partially compensate for the closure of the OPCJ valve 24. Possibly, the recovery strategy can also provide for preventing the OPCJ valve 24 to be powered, namely to be commanded in the closed state, because it would be a mere waste of energy. The above mentioned operations can delay the engine damages that can arise from the OPCJ valve 24 being stuck closed, but they cannot prevent them definitely. For this reason the recovery strategy should always provide for signaling to the user (namely the driver of the vehicle on which the ICE 110 is mounted), for example by lighting a warning light, that a fault has occurred which requires to be dealt with as soon as possible.

It should be understood that the diagnostic strategy described above is particularly effective if performed as the pressure value PM in the main oil gallery 13 is stable. For this reason, the diagnostic strategy is preferably performed after a certain time from an instant in which the OPCJ valve 24 is switched from the closing state to the opening state, or from an instant in which the OPCJ valve 24 is switched from the opening state to the closing state.

According to an embodiment, this diagnostic method is performed by the ECU 450 using a computer program comprising a program-code for carrying out all the steps described above. The computer program is stored in a data carrier 455 electrically coupled to the ECU 450, which is connected in turn to the wide range pressure sensor 19 and to the switch pressure sensor 23, as well as to the OPCJ valve 24. In this way, when the ECU 450 executes the computer program, and all of the steps of the diagnostic method described above are carried out.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the forgoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and in their legal equivalents.

What is claimed is:

1. A method for diagnosing a fault of an oil piston cooling jets valve of an internal combustion engine, the method comprising the steps of:

sensing a value of pressure in a main oil gallery with a sensor;

checking a commanded state of the oil piston cooling jets valve, the commanded state being a first state for opening a communication between the main oil gallery and an auxiliary oil gallery or a second state for closing the communication;

checking whether a value of pressure in the auxiliary oil gallery exceeds a predetermined threshold value thereof, above which a jet nozzle of the auxiliary oil gallery automatically opens;

identifying, with an electronic control unit (ECU), a fault of the oil piston cooling jets valve when the value of pressure in the main oil gallery exceeds the predetermined threshold value by a predetermined quantity and when a result of the checking in the auxiliary oil gallery indicates that the oil piston cooling jets valve is in a different state than the commanded state.

2. A method according to claim 1, wherein the value of pressure in the auxiliary oil gallery is determined to exceed the predetermined threshold value when the value of pressure in the main oil gallery exceeds the predetermined threshold value by the predetermined quantity and when the oil piston cooling jets valve is commanded in the first state for opening the communication.

3. A method according to claim 1, wherein the value of pressure in the auxiliary oil gallery is determined to not exceed the predetermined threshold value when the value of pressure in the main oil gallery exceeds the predetermined threshold value by the predetermined quantity and when the oil piston cooling jets valve is commanded in the second state for closing the communication.

4. A method according to claim 1, wherein identifying comprises identifying the fault of the oil piston cooling jets valve when the value of pressure in the main oil gallery exceeds the predetermined threshold value by the predetermined quantity that quantifies a pressure drop between the main oil gallery and the auxiliary oil gallery.

5. A method according to claim 4, wherein identifying comprises identifying the fault of the oil piston cooling jets valve when the value of pressure in the main oil gallery exceeds the predetermined threshold value by the predetermined quantity that is determined as a function of a value of engine speed and a value of oil temperature.

6. A non-transitory computer readable medium embodying a computer program product, the computer program product comprising:

a program for diagnosing a fault of an oil piston cooling jets valve of an internal combustion engine, the program configured to:

sense a value of pressure in a main oil gallery;

check a commanded state of the oil piston cooling jets valve, the commanded state being a first state for opening a communication between the main oil gallery and an auxiliary oil gallery or a second state for closing the communication;

check whether a value of pressure in the auxiliary oil gallery exceeds a predetermined threshold value thereof, above which a jet nozzle of the auxiliary oil gallery automatically opens;

identify a fault of the oil piston cooling jets valve when the value of pressure in the main oil gallery exceeds the predetermined threshold value by a predetermined quantity and when a result of the checking in the auxiliary oil gallery indicates that the oil piston cooling jets valve is in a different state than the commanded state.

7. The computer readable medium according to claim 6, wherein the value of pressure in the auxiliary oil gallery is determined to exceed the predetermined threshold value when the value of pressure in the main oil gallery exceeds the predetermined threshold value by the predetermined quantity and when the oil piston cooling jets valve is commanded in the first state for opening the communication.

8. The computer readable medium according to claim 6, wherein the value of pressure in the auxiliary oil gallery is determined to not exceed the predetermined threshold value when the value of pressure in the main oil gallery exceeds the predetermined threshold value by the predetermined quantity and when the oil piston cooling jets valve is commanded in the second state for closing the communication.

9. The computer readable medium according to claim 6, wherein the predetermined quantity quantifies a pressure drop between the main oil gallery and the auxiliary oil gallery.

10. The computer readable medium according to claim 9, wherein the predetermined quantity is determined as a function of a value of engine speed and a value of oil temperature.

11. An internal combustion engine comprising:

an oil piston cooling jets valve;

an engine control unit;

a non-transitory data carrier electrically coupled to the engine control unit; and a computer program for diagnosing a fault of the oil piston cooling jets valve of the internal combustion engine, the computer program stored in the non-transitory data carrier and configured to:

sense a value of pressure in a main oil gallery;

check a commanded state of the oil piston cooling jets valve, the commanded state being a first state for opening a communication between the main oil gallery and an auxiliary oil gallery or a second state for closing the communication;

check whether a value of pressure in the auxiliary oil gallery exceeds a predetermined threshold value thereof, above which a jet nozzle of the auxiliary oil gallery automatically opens;

identify a fault of the oil piston cooling jets valve when the value of pressure in the main oil gallery exceeds the predetermined threshold value by a predetermined quantity and when a result of the checking in the auxiliary oil gallery indicates that the oil piston cooling jets valve is in a different state than the commanded state.

12. The internal combustion engine according to claim 11, wherein the value of pressure in the auxiliary oil gallery is determined to exceed the predetermined threshold value when the value of pressure in the main oil gallery exceeds the predetermined threshold value by the predetermined quantity and when the oil piston cooling jets valve is commanded in the first state for opening the communication.

13. The internal combustion engine according to claim 11, wherein the value of pressure in the auxiliary oil gallery is determined to not exceed the predetermined threshold value when the value of pressure in the main oil gallery exceeds the predetermined threshold value by the predetermined quantity and when the oil piston cooling jets valve is commanded in the second state for closing the communication.

14. The internal combustion engine according to claim 11, wherein the predetermined quantity quantifies a pressure drop between the main oil gallery and the auxiliary oil gallery.

15. The internal combustion engine according to claim 14, wherein the predetermined quantity is determined as a function of a value of engine speed and a value of oil temperature.

16. An apparatus for diagnosing a fault of an oil piston cooling jets valve of an internal combustion engine, wherein the apparatus comprises:

means for sensing a value of pressure in a main oil gallery;

means for checking a commanded state the oil piston cooling jets valve, the commanded state being a first state for opening a communication between the main oil gallery and an auxiliary oil gallery or a second state for closing the communication;

means for checking whether a value of pressure in the auxiliary oil gallery exceeds a predetermined threshold value thereof, above which a jet nozzle of the auxiliary oil gallery automatically opens;

means for identifying a fault of the oil piston cooling jets valve when the value of pressure in the main oil gallery exceeds the predetermined threshold value by a predetermined quantity and when the value of pressure in the auxiliary oil gallery indicates that the oil piston cooling jets valve is in a different state than the commanded state.

17. An automotive system comprising:

an internal combustion engine including a main oil gallery and an auxiliary oil gallery communicating via an oil piston cooling jets valve;

a jet nozzle communicating with the auxiliary oil gallery;

a wide range pressure sensor located in the main oil gallery;

a switch pressure sensor located in the auxiliary oil gallery; and an electronic control unit (ECU) in communication with the oil piston cooling jets valve, with the wide range pressure sensor, and with the switch pressure sensor, wherein the ECU is configured to:

sense a value of pressure in the main oil gallery from the wide range pressure sensor;

check a commanded state of the oil piston cooling jets valve, the commanded state being a first state for opening a communication between the main oil gallery and the auxiliary oil gallery or a second state for closing the communication between the main oil gallery and the auxiliary oil gallery;

compare, by means of the switch pressure sensor, whether a value of pressure in the auxiliary oil gallery exceeds a predetermined threshold value thereof, above which the jet nozzle of the auxiliary oil gallery automatically opens, identify a fault of the oil piston cooling jets valve when the value of pressure in the main oil gallery exceeds the predetermined threshold value by a predetermined quantity and when the value of pressure in the auxiliary oil gallery indicates that the oil piston cooling jets valve is in a different state than the commanded state.

18. The automotive system according to claim 17, wherein the value of pressure in the auxiliary oil gallery is to exceed the predetermined threshold value when the value of pressure in the main oil gallery exceeds the predetermined threshold value by the predetermined quantity and when the oil piston cooling jets valve is commanded in the first state for opening the communication.

19. The automotive system according to claim 17, wherein the value of pressure in the auxiliary oil gallery is determined to not exceed the predetermined threshold value when the value of pressure in the main oil gallery exceeds the predetermined threshold value by the predetermined quantity and when the oil piston cooling jets valve is commanded in the second state for closing the communication.

20. The automotive system according to claim 17, wherein the predetermined quantity quantifies a pressure drop between the main oil gallery and the auxiliary oil gallery.

* * * * *